US010781994B2

(12) United States Patent
Yano

(10) Patent No.: US 10,781,994 B2
(45) Date of Patent: Sep. 22, 2020

(54) VENTILATION MEMBER AND LAMP

(71) Applicant: NITTO DENKO CORPORATION, Ibaraki-shi, Osaka (JP)

(72) Inventor: Youzou Yano, Ibaraki (JP)

(73) Assignee: NITTO DENKO CORPORATION, Ibaraki (JP)

( * ) Notice: Subject to any disclaimer, the term of this patent is extended or adjusted under 35 U.S.C. 154(b) by 31 days.

(21) Appl. No.: 16/061,786

(22) PCT Filed: Dec. 5, 2016

(86) PCT No.: PCT/JP2016/086015
§ 371 (c)(1),
(2) Date: Jun. 13, 2018

(87) PCT Pub. No.: WO2017/104457
PCT Pub. Date: Jun. 22, 2017

(65) Prior Publication Data

US 2018/0356065 A1 Dec. 13, 2018

(30) Foreign Application Priority Data

Dec. 15, 2015 (JP) ..... 2015-244283

(51) Int. Cl.
*F21S 43/20* (2018.01)
*F21V 31/03* (2006.01)
(Continued)

(52) U.S. Cl.
CPC ..... *F21S 43/26* (2018.01); *F21S 43/00* (2018.01); *F21S 43/50* (2018.01); *F21S 45/30* (2018.01); *F21V 31/03* (2013.01)

(58) Field of Classification Search
None
See application file for complete search history.

(56) References Cited

U.S. PATENT DOCUMENTS 6,364,924 B1 * 4/2002 Mashiko ..... F21S 45/37 55/385.4
8,069,875 B2 * 12/2011 Mashiko ..... B01D 53/261 137/512
(Continued)

FOREIGN PATENT DOCUMENTS

CN 101629712 A 1/2010
CN 103959923 A 7/2014
(Continued)

OTHER PUBLICATIONS

Feb. 14, 2017 International Search Report issued in International Patent Application No. PCT/JP2016/086015.
(Continued)

*Primary Examiner* — Elmito Breval
(74) *Attorney, Agent, or Firm* — Oliff PLC

(57) ABSTRACT

A ventilation member includes: a cylindrical holding member including an outer projection portion; a ventilation film mounted to cover one end of the holding member in a centerline direction, the ventilation film preventing a liquid and solid from entering the holding member, the ventilation film permitting a flow of gas between the inside and the outside; and a cover member provided around the holding member, the cover member including a side wall portion, a top portion, and an inner projection portion, the top portion closing one end of the side wall portion in the centerline direction, the inner projection portion projecting inward from an inner circumferential surface of the side wall portion and contacting the outer projection portion of the holding member so as to form a ventilation passage between the ventilation film and the top portion, the ventilation passage allowing gas to flow therethrough.

9 Claims, 11 Drawing Sheets

(51) Int. Cl.

| | |
|---|---|
| ***F21S 43/00*** | (2018.01) |
| ***F21S 43/50*** | (2018.01) |
| ***F21S 45/30*** | (2018.01) |

(56) References Cited

U.S. PATENT DOCUMENTS

| | | | | |
|---|---|---|---|---|
| 8,475,554 | B2 * | 7/2013 | Furuuchi | F21V 31/03 55/385.4 |
| 2008/0092741 | A1 * | 4/2008 | Furuuchi | F21V 31/03 96/9 |
| 2009/0029641 | A1 * | 1/2009 | Furuuchi | F16K 15/147 454/259 |
| 2009/0047890 | A1 | 2/2009 | Yano et al. | |
| 2009/0084078 | A1 | 4/2009 | Furuyama et al. | |
| 2009/0109618 | A1 | 4/2009 | Yano | |
| 2013/0025457 | A1 | 1/2013 | Furuuchi et al. | |
| 2013/0139484 | A1 | 6/2013 | Furuyama et al. | |
| 2014/0090561 | A1 | 4/2014 | Furuyama et al. | |
| 2014/0318374 | A1 | 10/2014 | Yano | |
| 2014/0331562 | A1 | 11/2014 | Shinmura et al. | |
| 2016/0174397 | A1 * | 6/2016 | Ishii | F21V 31/03 55/385.4 |
| 2016/0369971 | A1 | 12/2016 | Tezuka et al. | |

FOREIGN PATENT DOCUMENTS

| | | | |
|---|---|---|---|
| EP | 1955901 | A1 | 8/2008 |
| EP | 2557356 | A1 | 2/2013 |
| EP | 2733418 | A1 * | 5/2014 |
| FR | 2414849 | A7 | 8/1979 |
| JP | 2001-143524 | A | 5/2001 |
| JP | 2007-087666 | A | 4/2007 |
| JP | 2007-230448 | A | 9/2007 |
| JP | 2013-114829 | A | 6/2013 |
| JP | 2014-032741 | A | 2/2014 |
| KR | 200218158 | Y1 | 3/2001 |
| WO | 2014021552 | A1 | 2/2014 |
| WO | 2015/083324 | A1 | 6/2015 |

OTHER PUBLICATIONS

Mar. 6, 2020 Extended Search Report issued in European Patent Appplication No. 16875440.6.

* cited by examiner

VENTILATION MEMBER AND LAMP

TECHNICAL FIELD

The present invention relates to a ventilation member and a lamp.

BACKGROUND ART

Ventilation property has conventionally been required of an apparatus such as a vehicle lamp e.g., head lamp, rear lamp, fog lamp and turn lamp, an inverter, a converter, an electronic control unit (ECU) and a battery box to allow for elimination of a differential pressure generated inside the housing due to temperature change. These apparatuses have also been required of dust-proof property to prevent a foreign material from entering the housing, water-proof property to prevent water from infiltrating the housing, oil-repellant property to prevent oil from infiltrating the housing, and CCT-proof property to prevent salt from entering the housing. For this reason, these apparatuses are provided with a ventilation member having these functions of ventilation property, dust-proofness, water-proofness, oil-repellency and CCT-proofness.

For example, Patent Document 1 discloses an air-permeable cap (a ventilation member) wherein a substantially cylindrical body of a substantially cylindrical shape is fitted in a closed-end cylindrical cover member, an air passage is formed between an inner wall of the cover member and an outer wall of the substantially cylindrical body and between a bottom surface of the cover member and a lower end of the substantially cylindrical body, and a top opening portion of the substantially cylindrical body is formed at a mounting portion to be mounted on a mounting opening of an apparatus housing. Further, a bottom opening of the substantially cylindrical body is covered with an air-permeable filter.

CITATION LIST

Patent Literature

Patent Document 1: Japanese Patent Application Laid-Open Publication No. 2001-143524

SUMMARY OF INVENTION

Technical Problem

With the configuration where a rib is formed on a cover member to secure a ventilation passage between the cover member and a ventilation body (a filter member) having ventilation property, the rib of the cover member may contact the ventilation body, which may result in buckling of the ventilation body. Further, due to the rib being located in the vicinity of the ventilation body, a liquid having infiltrated into the ventilation passage may adhere to the rib by surface tension and accumulate on the ventilation body. This buckling of the ventilation body and accumulation of a liquid on the ventilation body may impair the functions of ventilation property, dust-proofness, water-proofness, oil-repellency and CCT-proofness.

An object of the present invention is to provide a ventilation member and a lamp that are capable of preventing buckling of the ventilation member and accumulation of a liquid on the ventilation member.

Solution to Problem

With this object in view, the present invention is a ventilation member (1) including: a cylindrical member (20) of a cylindrical shape, the cylindrical member (20) including an outer projection portion (22) projecting outward from an outer circumferential surface of the cylindrical member (20); a ventilation body (10) mounted so as to cover one end of the cylindrical member (20) in a centerline direction, the ventilation body (10) preventing a liquid and a solid from entering an inside of the cylindrical member (20) from an outside of the cylindrical member (20), the ventilation body (10) permitting a flow of gas between the inside and the outside; and a cover member (30) provided around the ventilation body (10), the cover member (30) including a cylindrical portion (31), a lid portion (33), and an inner projection portion (32), the lid portion (33) closing one end of the cylindrical portion (31) in the centerline direction, the inner projection portion (32) projecting inward from an inner circumferential surface of the cylindrical portion (31) and contacting the outer projection portion (22) of the cylindrical member (20) so as to form a ventilation passage (R) between the ventilation body (10) and the lid portion (33), the ventilation passage (R) allowing gas to flow therethrough.

Here, the ventilation passage (R) may be formed by contact between one end face (22*a*) of the outer projection portion (22) of the cylindrical member (20) in the centerline direction and the other end face (32*aa*) of the inner projection portion (32) of the cover member (30) in the centerline direction.

Further, the cover member (30) may be prevented from moving to one side in the centerline direction by contact between an outer circumferential surface of the outer projection portion (22) of the cylindrical member (20) and an inner surface (32*ba*) of the inner projection portion (32) of the cover member (30).

Here, the outer circumferential surface of the outer projection portion (22) of the cylindrical member (20) may be parallel to the centerline direction, and the inner surface (32*ba*) of the inner projection portion (32) of the cover member (30) may gradually go inward as the inner surface (32*ba*) goes from one side toward the other side in the centerline direction.

In another aspect, the present invention is a ventilation member (3) including: a cylindrical member (320) of a cylindrical shape, the cylindrical member (320) including an outer projection portion (322) projecting outward from an outer circumferential surface of the cylindrical member (320); a ventilation body (10) mounted so as to cover one end of the cylindrical member (320) in a centerline direction, the ventilation body (10) preventing a liquid and a solid from entering an inside of the cylindrical member (320) from an outside of the cylindrical member (320), the ventilation body (10) permitting a flow of gas between the inside and the outside; and a cover member (330) provided around the ventilation body (10), the cover member (330) including a cylindrical portion (331) and a lid portion (333), the lid portion (333) closing one end of the cylindrical portion (331) in the centerline direction, the cylindrical portion (331) contacting the outer projection portion (322) of the cylindrical member (320) so as to form a ventilation passage (R) between the ventilation body (10) and the lid portion (333), the ventilation passage (R) allowing gas to flow therethrough.

Here, the cylindrical portion (331) of the cover member (330) may be press-fitted to the outer projection portion (322) of the cylindrical member (320), and an interference of a press-fitting portion may be larger on the other side than on one side in the centerline direction.

In still another aspect, the present invention is a ventilation member (1) including: a ventilation body (10) mounted so as to cover one end of a cylindrical portion (21) in a centerline direction, the ventilation body (10) preventing a liquid and a solid from entering an inside of the cylindrical portion (21) from an outside of the cylindrical portion (21), the ventilation body (10) permitting a flow of gas between the inside and the outside; a surrounding portion (31, 33) provided around the ventilation body (10); and a preventing portion (22, 32) at a position where the ventilation body (10) is not mounted, the preventing portion (22, 32) preventing the ventilation body (10) and the surrounding portion (31, 33) from coming close to each other in the centerline direction.

Here, the preventing portion (22, 32) may include an outer projection portion (22) projecting outward from the cylindrical portion (21), and an inner projection portion (32) projecting inward from a portion of the surrounding portion (31, 33) provided around the cylindrical portion (21), the inner projection portion (32) contacting the outer projection portion (22) in the centerline direction.

In still another aspect, the present invention is a lamp including: a housing (100) storing a light source; and a ventilation member (1) mounted on the housing (100), the ventilation member (1) preventing a liquid and a solid from entering an inside of the housing (100), the ventilation member (1) permitting a flow of gas between the inside and an outside of the housing (100), wherein the ventilation member (1) includes: a cylindrical member (20) of a cylindrical shape, the cylindrical member (20) including an outer projection portion (22) projecting outward from an outer circumferential surface of the cylindrical member (20); a ventilation body (10) mounted so as to cover one end of the cylindrical member (20) in a centerline direction, the ventilation body (10) preventing a liquid and a solid from entering an inside of the cylindrical member (20) from an outside of the cylindrical member (20), the ventilation body (10) permitting a flow of gas between the inside and the outside; and a cover member (30) provided around the ventilation body (10), the cover member (30) including a cylindrical portion (31), a lid portion (33), and an inner projection portion (32), the lid portion (33) closing one end of the cylindrical portion (31) in the centerline direction, the inner projection portion (32) projecting inward from an inner circumferential surface of the cylindrical portion (31) and contacting the outer projection portion (22) of the cylindrical member (20) so as to form a ventilation passage (R) between the ventilation body (10) and the lid portion (33), the ventilation passage (R) allowing gas to flow therethrough.

Note that the above reference signs in this section are added as examples for explaining the present invention and the present invention is not limited by these reference signs.

Advantageous Effects of Invention

According to the present invention, it is possible to prevent buckling of the ventilation body and accumulation of a liquid on the ventilation body.

DESCRIPTION OF EMBODIMENTS

Hereinafter, exemplary embodiments of the present invention will be described in detail with reference to the attached drawings.

First Exemplary Embodiment

Figure 1:
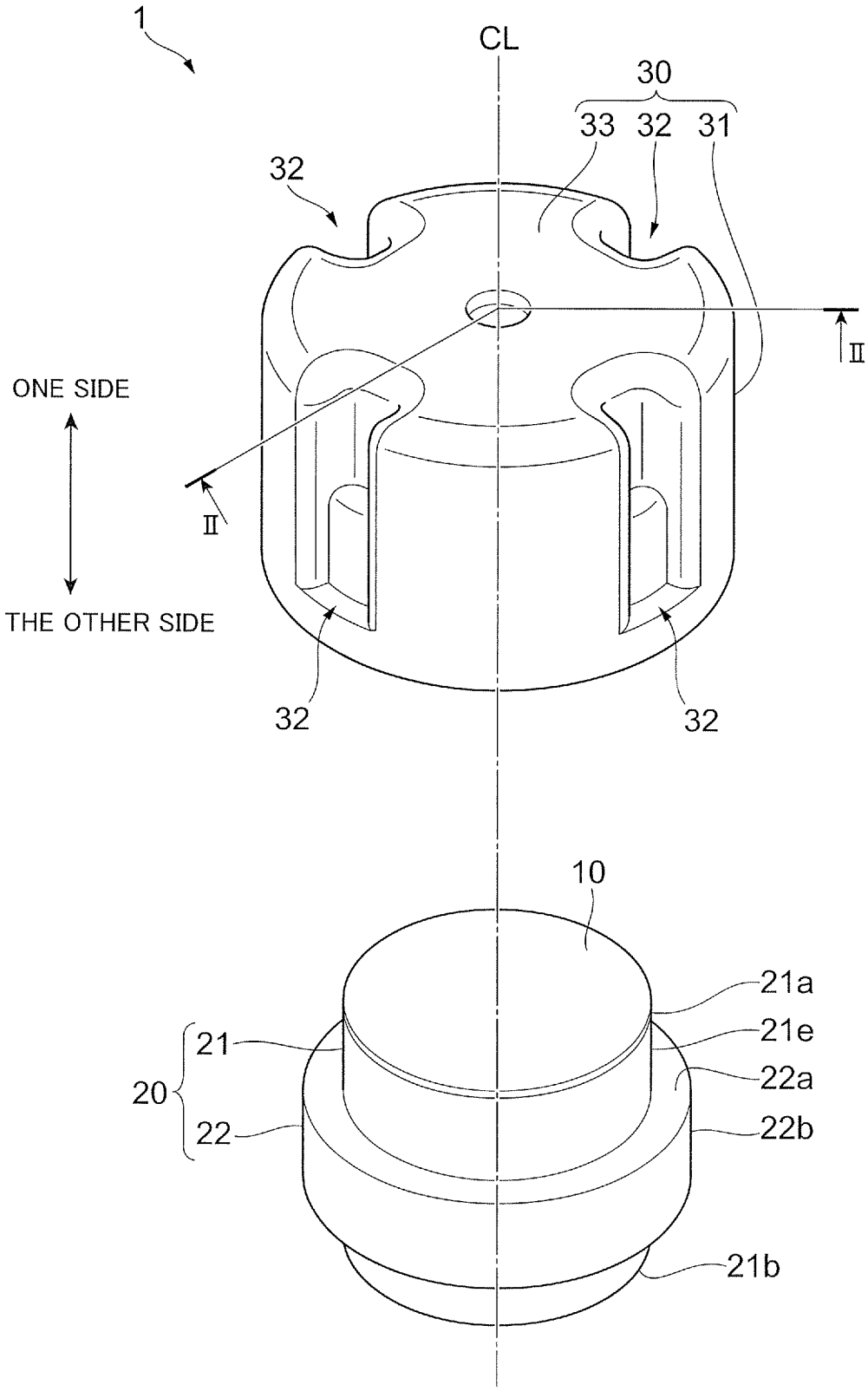
FIG. 1 is a diagram illustrating a schematic configuration of a ventilation member according to the first exemplary embodiment.

FIG. 1 is a diagram illustrating a schematic configuration of a ventilation member 1 according to the first exemplary embodiment.

Figure 2:
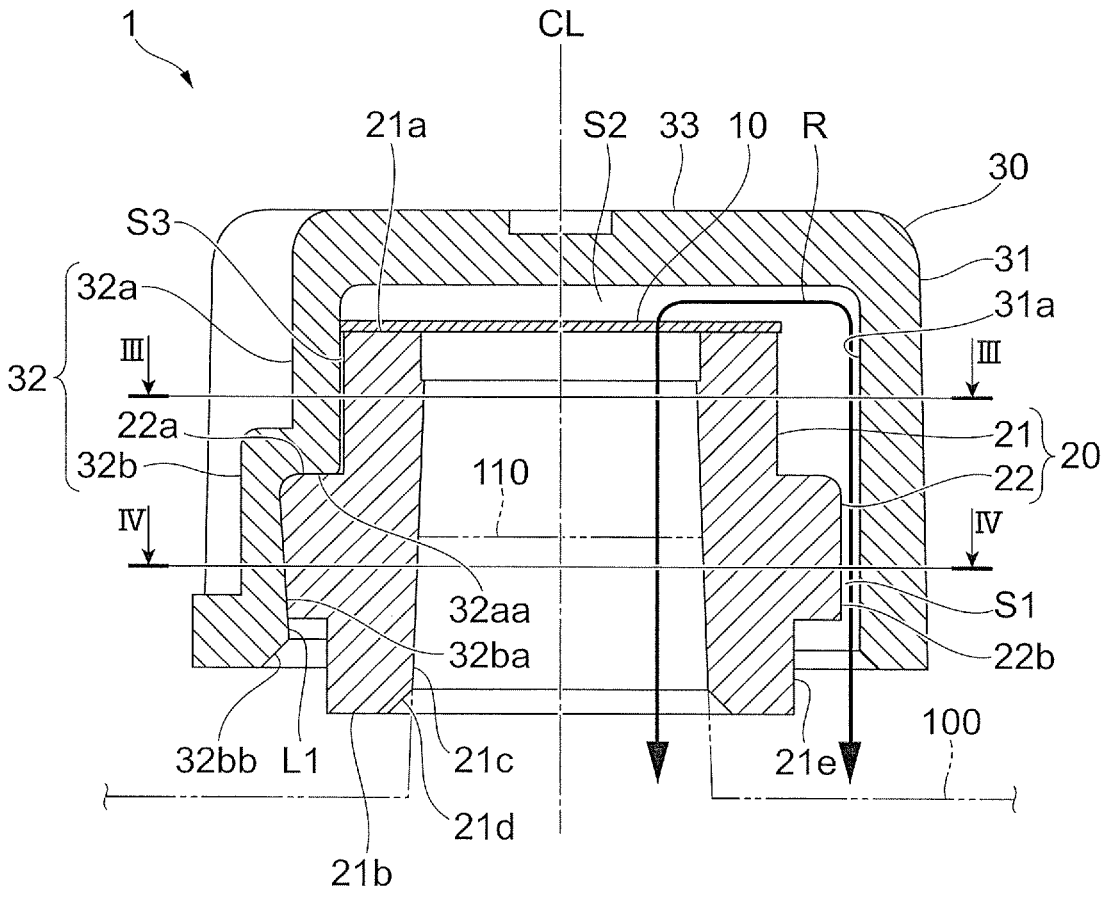
FIG. 2 is a cross-sectional view of the ventilation member according to the first exemplary embodiment taken along the line II-II in FIG. 1.

FIG. 2 is a cross-sectional view of the ventilation member 1 according to the first exemplary embodiment taken along the line II-II in FIG. 1.

Figure 3:
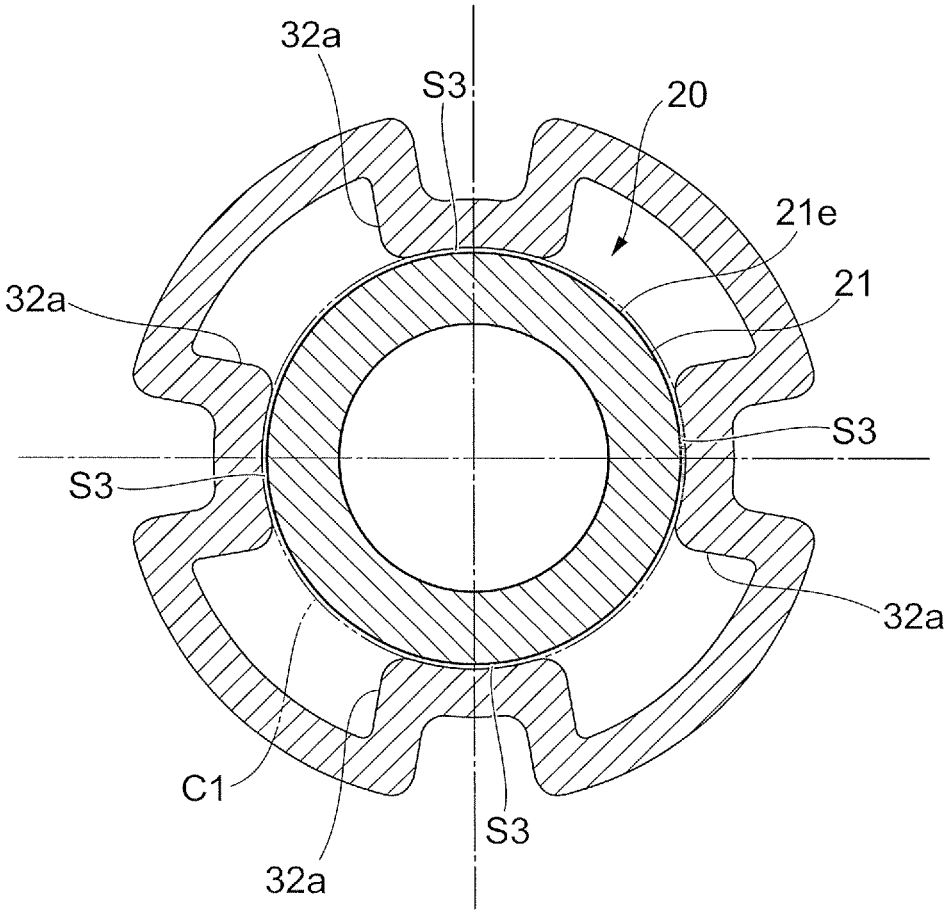
FIG. 3 is a cross-sectional view taken along the line III-III in FIG. 2.

FIG. 3 is a cross-sectional view taken along the line III-III in FIG. 2.

Figure 4:
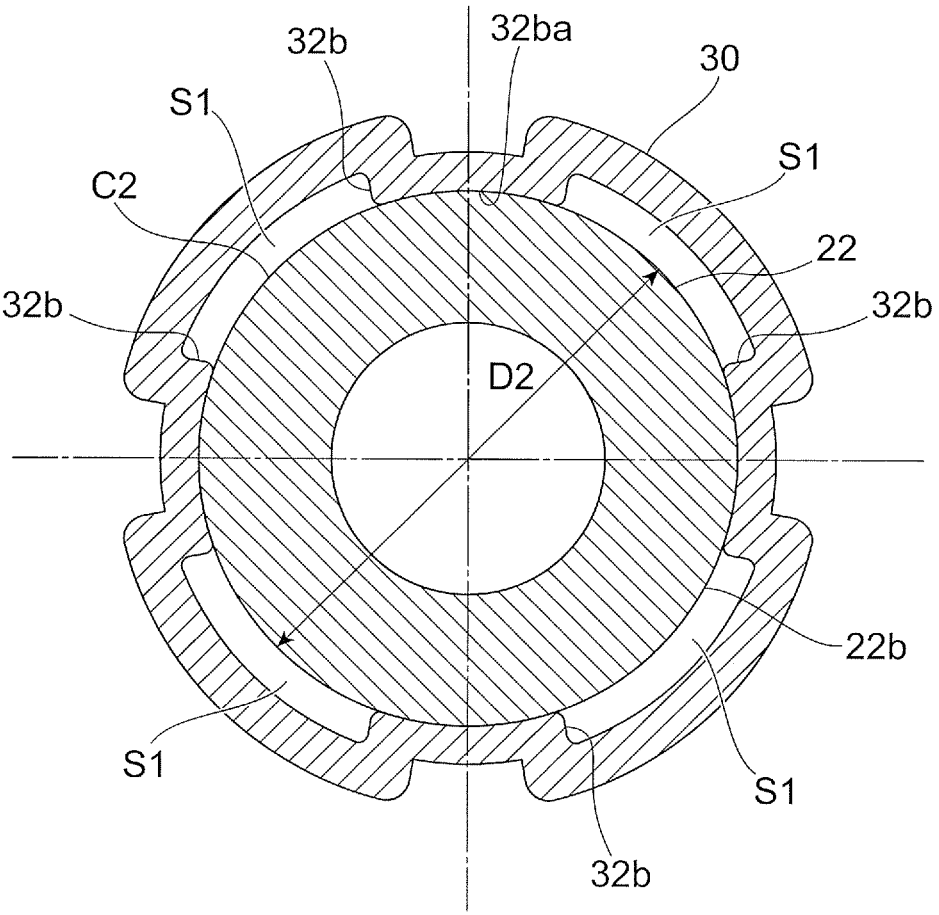
FIG. 4 is a cross-sectional view taken along the line IV-IV in FIG. 2.

FIG. 4 is a cross-sectional view taken along the line IV-IV in FIG. 2.

The ventilation member 1 is mounted on an apparatus housing 100 of an apparatus such as a vehicle lamp e.g., head lamp, rear lamp, fog lamp and turn lamp, an inverter, a converter, an electronic control unit (ECU) and a battery box. FIG. 2 shows, by a dashed-two dotted line, a mounted portion 110 that is formed in the apparatus housing 100 as a portion for mounting the ventilation member 1 and having an open end.

The ventilation member 1 includes a ventilation film 10 as an example of the ventilation body that prevents a liquid and a solid from entering the inside of the apparatus housing 100 from the outside of the apparatus housing 100 and has holes for permitting a flow of gas between the inside and the outside of the apparatus housing 100.

The ventilation member 1 further includes a holding member 20 as an example of the cylindrical member that holds the ventilation film 10, and a cover member 30 that covers a periphery of the ventilation film 10.

[Ventilation Film 10]

The ventilation film 10 is a disk-shaped film. The outer diameter of the ventilation film 10 is larger than the diameter of a circle C1 (described later) and smaller than the diameter of an inner circumferential surface 31*a* of a side wall portion 31 (described later) of the cover member 30.

The structure and material of the ventilation film 10 is not particularly limited as long as the ventilation film 10 permits penetration of gas and prevents penetration of liquids. Examples of the ventilation film 10 include cloth, resin and metal that are mesh-shaped or fibrous. For example, the ventilation film 10 may be woven fabric, nonwoven fabric, resin mesh, net, sponge, metal porous body or metal mesh.

The ventilation film 10 according to the first exemplary embodiment is a film consisting of a porous resin film and a reinforcing layer laminated on the porous resin film to reinforce the ventilation film 10.

Examples of the material of the porous resin film include a fluororesin porous body and a polyolefin porous body that can be manufactured by a known stretching method or extraction method. Example of fluororesin include PTFE (polytetrafluoroethylene), polychlorotrifluoroethylene, tetrafluoroethylene-hexafluoropropylene copolymer, tetrafluoroethylene-ethylene copolymer. Examples of the monomer constituting polyolefin include ethylene, propylene, 4-methylpentene-1 and 1-butene, and polyolefin obtained by polymerizing one of these monomers or copolymerizing these monomers may be used. Also, the material of the porous resin film may be in the form of a blend or a layered structure of two or more kinds of the above polyolefin.

Also, examples of the material of the porous resin film further include a nanofiber film porous body using polyacrylonitrile, nylon or polylactate.

The ventilation film 10 according to the first exemplary embodiment uses an PTFE porous film because the PTFE porous film can ensure a sufficient amount of ventilation even with a small area and is highly capable of preventing water and dust from entering the inside of the apparatus housing 100.

An average hole diameter of the holes formed in the ventilation film 10 is in the range of not less than 0.01 μm and not more than 100 μm for example. In this range, the average hole diameter is preferably in the range of not less than 0.1 μm and not more than 50 μm, and more preferably in the range of not less than 0.5 μm and not more than 10 μm.

If the average hole diameter of the holes formed in the ventilation film 10 is less than 0.01 μm, it is difficult for air to pass through the ventilation film 10. On the other hand, if the average hole diameter of the ventilation film 10 is more than 100 μm, liquids and solids may easily enter the inside of the apparatus housing 100 through the ventilation film 10.

Although the thickness of the ventilation film 10 is not particularly limited, the thickness may be in the range of not less than 10 μm and not more than 1000 μm for example.

If the ventilation film 10 is extremely thin, the strength of the ventilation film 10 is likely to weaken. On the other hand, if the ventilation film 10 is extremely thick, the size of the ventilation member 1 is likely to increase.

The surface (of an outer side in particular) of the ventilation film 10 may be applied with a liquid-repellent treatment such as a water-repellent treatment and an oil-repellent treatment. Applying a liquid-repellent treatment to the ventilation film 10 prevents dirt and the like from adhering to the ventilation film 10. As a result, this prevents clogging of the ventilation film 10.

For example, a liquid-repellent treatment to the ventilation film 10 may be performed by applying, to the surface of the ventilation film 10, a liquid-repellent agent composed of a compound having a hydrocarbon group (perfluoroalkyl group) saturated with fluorine in a side chain and having a main chain of acrylic, methacrylic, silicone or other nature. The method for applying a liquid-repellent agent to the surface of the ventilation film 10 is not particularly limited; for example, gravure coating, spray coating, kiss coating or dipping may be used.

The method of an oil-repellent treatment is not particularly limited as long as an oil-repellent film containing a polymer having a perfluoroalkyl group can be formed. Examples of the forming method include coating of a solution or a dispersion of a polymer having a perfluoroalkyl group by an air spray method, an electrostatic spray method, a dip coating method, a spin coating method, a roll coating method, a curtain flow coating method or an impregnation method, and film formation by electrodeposition coating or plasma polymerization.

[Holding Member 20]

The holding member 20 includes a cylindrical portion 21 of a cylindrical shape, and an outer projection portion 22 projecting outward from the cylindrical portion 21.

The holding member 20 holds the ventilation film 10 at one end 21*a* of the cylindrical portion 21 in a direction of the centerline CL (hereinafter may be referred to as the "centerline direction"). The ventilation film 10 covers an opening at one end of the cylindrical portion 21 in the centerline direction. The method for fixing the ventilation film 10 to the cylindrical portion 21 will be described in detail later. Further, the holding member 20 is mounted on the apparatus housing 100 with the other end 21*b* of the cylindrical portion 21 in the centerline direction being press-fitted to the mounted portion 110 of the apparatus housing 100. In other words, a contact pressure generated between an inner circumferential surface 21*c* on the other end 21*b* side of the cylindrical portion 21 and the apparatus housing 100 prevents the holding member 20 from falling off the mounted portion 110 of the apparatus housing 100. A chamfer 21*d* is formed at an inner portion of the other end 21*b* side of the cylindrical portion 21.

The outer projection portion 22 is a cylindrical portion projecting outward from an outer circumferential surface 21*e* of the cylindrical portion 21. One end face 22*a*, which is an end face on the one side of the outer projection portion 22 in the centerline direction, is a surface substantially perpendicular to the centerline direction. An outer circumferential surface 22*b* of the outer projection portion 22 is a surface substantially parallel to the centerline direction.

Examples of the material of the holding member 20 include thermoplastic resin, which is easy to mold. Examples of the thermoplastic resin include polybutylene terephthalate (PBT), polyphenylene sulfide (PPS), polysulfone (PS), polypropylene (PP), polyethylene (PE), ABS resin, thermoplastic elastomer and a composite material of these materials. Other than the above thermoplastic resin, the material of the holding member 20 may be a composite material produced by compositing thermoplastic resin with a reinforcing material such as glass fiber and carbon fiber, or metal for improved heat resistance, dimension stability and rigidity. Further, the material of the holding member 20 may be a metal or a synthetic rubber including NBR (nitrile rubber), EPDM (ethylene-propylene rubber), silicone rubber, fluoro-rubber, acrylic rubber and hydrogenated nitrile rubber.

The method for forming the holding member 20 is not particularly limited, and examples include injection molding and cutting.

The surface (of an outer side in particular) of the holding member 20 may be applied with a liquid-repellent treatment such as a water-repellent treatment and an oil-repellent treatment. Applying a liquid-repellent treatment to the holding member 20 prevents dirt and the like from adhering to the holding member 20. As a result, this prevents clogging of the ventilation film 10. For example, the water-repellent treatment and the oil-repellent treatment to the holding member 20 may be the same as those to the ventilation film 10 as described above.

The method for fixing the ventilation film 10 to the holding member 20 may be thermal welding such as iron welding, ultrasonic welding and laser welding in the case where the holding member 20 is thermoplastic resin. Alternatively, the ventilation film 10 may be fixed to the holding member 20 by insert molding, which injects resin into a die in which the ventilation film 10 is set.

[Cover Member 30]

The cover member 30 includes: a side wall portion 31 having a basically cylindrical shape and as an example of the cylindrical portion; an inner projection portion 32 projecting inward from an inner circumferential surface 31*a* of the side wall portion 31; and a disk-shaped top portion 33 covering an opening at one end of the side wall portion 31 and the inner projection portion 32 in the centerline direction and as an example of the lid portion. In FIG. 2, a cross-sectional shape of the side wall portion 31 and the top portion 33 is shown on the right side of the centerline CL, and a cross-sectional shape of the inner projection portion 32 and the top portion 33 is shown on the left side of the centerline CL.

The side wall portion 31 is formed such that a gap S1 is formed between the inner circumferential surface 31*a* of the side wall portion 31 and the outer circumferential surface 22*b* of the outer projection portion 22 of the holding member 20.

As shown in FIG. 1, plural (four in the first exemplary embodiment) inner projection portions 32 are formed in a circumferential direction at equal intervals and formed in the circumferential direction over a predetermined angle. As shown in FIG. 2, each inner projection portion 32 includes portions projecting inward in two stages from the inner circumferential surface 31*a* of the side wall portion 31, namely a first projection portion 32*a* on one side in the centerline direction, and a second projection portion 32*b* on the other side in the centerline direction. In other words, each inner projection portion 32 includes the second projection portion 32*b* projecting inward from the inner circumferential surface 31*a* of the side wall portion 31, and the first projection portion 32*a* projecting inward further from the second projection portion 32*b*.

The other end face 32*aa*, which is an end face on the other side of the first projection portion 32*a* in the centerline direction, is a surface substantially perpendicular to the centerline direction. Each of the other end faces 32*aa* of the plural (four in the first exemplary embodiment) first projection portions 32*a* is formed on the substantially same plane.

When the first projection portions 32*a* are cut in a plane perpendicular to the centerline CL, inner surfaces of the plural first projection portions 32*a* are formed substantially on the same circle C1, as shown in FIG. 3. The plural first projection portions 32*a* are formed such that the diameter of the circle C1 is larger than the outer diameter of the outer circumferential surface 21*e* of the cylindrical portion 21.

When the second projection portions 32*b* are cut in a plane perpendicular to the centerline CL, inner surfaces 32*ba* of the plural (four in the first exemplary embodiment) second projection portions 32*b* are formed substantially on the same circle C2, as shown in FIG. 4. Further, the inner surface 32*ba* of each second projection portion 32*b* gradually goes inward (to the centerline CL side) as it goes from the one side toward the other side in the centerline direction. More specifically, as shown in FIG. 2, when the second projection portions 32*b* are cut in a plane including the centerline CL, a straight line L1 depicting the inner surface 32*ba* of the second projection portion 32*b* is inclined with respect to the centerline CL, and the distance between the straight line L1 and the centerline CL is gradually smaller from the one side toward the other side in the centerline direction. In other words, the diameter D2 of the above circle C2 is gradually smaller from the one side toward the other side in the centerline direction.

The diameter D2 of the circle C2 at the one end of the plural second projection portions 32*b* in the centerline direction is substantially the same as the outer diameter of the outer circumferential surface 22*b* of the outer projection portion 22 of the holding member 20. The diameter D2 of the circle C2 is gradually smaller than the diameter of the outer circumferential surface 22*b* of the outer projection portion 22 of the holding member 20 from the one side toward the other side in the centerline direction.

Further, a chamfer 32*bb* is formed at an inner portion of the other end of the second projection portion 32*b* in the centerline direction.

As shown in FIG. 2, the top portion 33 is provided such that a gap S2 is formed between the top portion 33 and the ventilation film 10 in a state where the other end face 32*aa* of the cover member 30 and the one end face 22*a* of the holding member 20 contact each other.

In the ventilation member 1 with the above described configuration, the cover member 30 is assembled such that the other end face 32*aa* of the first projection portion 32*a* of the inner projection portion 32 of the cover member 30 contacts the one end face 22*a* of the outer projection portion 22 of the holding member 20, as shown in FIG. 2. In other words, the cover member 30 is pushed against the holding member 20 until the other end face 32*aa* of the cover member 30 abuts on the one end face 22*a* of the holding member 20. Thus, the inner projection portion 32 of the cover member 30 and the outer projection portion 22 of the holding member 20 are an example of the preventing portion that prevents, at a position where the ventilation film 10 is not mounted, the ventilation film 10 and the top portion 33, which is an example of the surrounding portion, of the cover member 30 from coming close to each other in the centerline direction.

Since the outer diameter of the ventilation film 10 is larger than the diameter of the circle C1 formed by the inner surfaces of the plural first projection portions 32*a* of the cover member 30, the outermost diameter portion of the ventilation film 10 contacts the inner surfaces of the first projection portions 32*a* of the cover member 30 in a state where the cover member 30 is assembled to the holding member 20.

As shown in FIGS. 2 and 4, in a state where the other end face 32*aa* of the cover member 30 and the one end face 22*a* of the holding member 20 contact each other, the gap S1, which is formed between the inner circumferential surface 31*a* of the side wall portion 31 of the cover member 30 and the outer circumferential surface 22*b* of the outer projection portion 22 of the holding member 20, and the gap S2, which is formed between the top portion 33 of the cover member 30 and the ventilation film 10, function as a ventilation passage R through which gas flows inside and outside the apparatus housing 100.

Further, a gap S3 formed between the first projection portion 32*a* of the cover member 30 and the outer circumferential surface 21*e* of the cylindrical portion 21 of the holding member 20 also functions as the ventilation passage R. However, since the inner surface of the first projection portion 32*a* of the cover member 30 is in contact with the ventilation film 10 as described above, liquids and solids are prevented from passing through the gap S3 to enter the gap S2 formed between the top portion 33 of the cover member 30 and the ventilation film 10.

In the ventilation member 1 with the above described configuration, the ventilation film 10 held by the holding member 20 is not sandwiched by the cover member 30 and the holding member 20 in a state where the other end face 32*aa* of the cover member 30 and the one end face 22*a* of the holding member 20 contact each other (in a state where the cover member 30 is assembled to the holding member 20). Thus the ventilation film 10 is free from buckling because the ventilation film 10 does not receive force from the cover member 30 when fixed to the holding member 20.

Further, since the cover member 30 is not present on the ventilation film 10 in a contacting manner, a liquid adhered to the cover member 30 by surface tension does not accumulate on the ventilation film 10.

Therefore, with the ventilation member 1 of the first exemplary embodiment, functions such as ventilation property, dust-proofness, water-proofness, oil-repellency and CCT-proofness are prevented from being impaired by buckling of the ventilation film 10 and accumulation of a liquid on the ventilation film 10.

Further, the inner surfaces 32*ba* of the plural second projection portions 32*b* of the cover member 30 gradually go inward (to the centerline CL side) as they go from the one side toward the other side in the centerline direction. In other words, when the inner surfaces 32*ba* of the plural second projection portions 32*b* of the cover member 30 are cut in a plane perpendicular to the centerline CL, the diameter D2 of the circle C2, which is formed by cross-sectional lines of the inner surfaces 32*ba* of the plural second projection portions 32*b*, is gradually smaller from the one side toward the other side in the centerline direction. On the other hand, the outer circumferential surface 22*b* of the outer projection portion 22 of the holding member 20 is a surface substantially parallel to the centerline direction. For this reason, when the cover member 30 is pushed against the holding member 20 until the other end face 32*aa* of the cover member 30 abuts on the one end face 22*a* of the holding member 20, the plural second projection portions 32*b* of the cover member 30 are press-fitted to the outer projection portion 22 of the holding member 20. Further, an interference between the plural second projection portions 32*b* of the cover member 30 and the outer projection portion 22 of the holding member 20 is gradually larger from the one side toward the other side in the centerline direction. As a result, even if a compression set occurs in the fitting portion (press-fitting portion) between the cover member 30 and the holding member 20, the cover member 30 hardly moves toward the one side with respect to the holding member 20 in the centerline direction, as compared with a case where the interference of the fitting portion (press-fitting portion) is constant. Thus the cover member 30 hardly falls off the holding member 20.

The outer circumferential surface 22*b* of the outer projection portion 22 of the holding member 20 may gradually go inward (to the centerline CL side) as it goes from the one side toward the other side in the centerline direction, similarly to the inner surface 32*ba* of the second projection portion 32*b* of the cover member 30. With the outer circumferential surface 22*b* of the outer projection portion 22 of the holding member 20 having this shape, the cover member 30 hardly falls off the holding member 20 too and the inner circumferential surface 21*c* of the holding member 20 is prevented from deforming while the cover member 30 is mounted to the holding member 20.

Consideration is now given to a vehicle lamp, such as head lamp, rear lamp, fog lamp and turn lamp, having the ventilation member 1 configured as above and the closed apparatus housing 100 storing an LED (light emitting diode) as an example of the light source emitting light.

When turned on, the LED stored in the apparatus housing 100 of the lamp generates heat to have high temperature. Accordingly, when the LED is turned on, an air in the internal space of the apparatus housing 100 of the lamp is heated to expand. On the other hand, when the LED is turned off, the LED stops generating heat and the heated air in the internal space of the apparatus housing 100 is cooled to shrink. In this way, when the pressure in the internal space of the apparatus housing 100 increases due to expansion of the air in the internal space and when the pressure in the internal space decreases due to shrinkage of the air in the internal space, gas flows through the ventilation passage R in the ventilation member 1 toward the outside of the lamp from the internal space of the apparatus housing 100, or toward the internal space of the apparatus housing 100 from the outside of the lamp. This prevents breakage of the apparatus housing 100 and the like due to sudden increase in the pressure in the internal space of the apparatus housing 100 and sudden decrease in the pressure in the internal space.

Second Exemplary Embodiment

Figure 5:
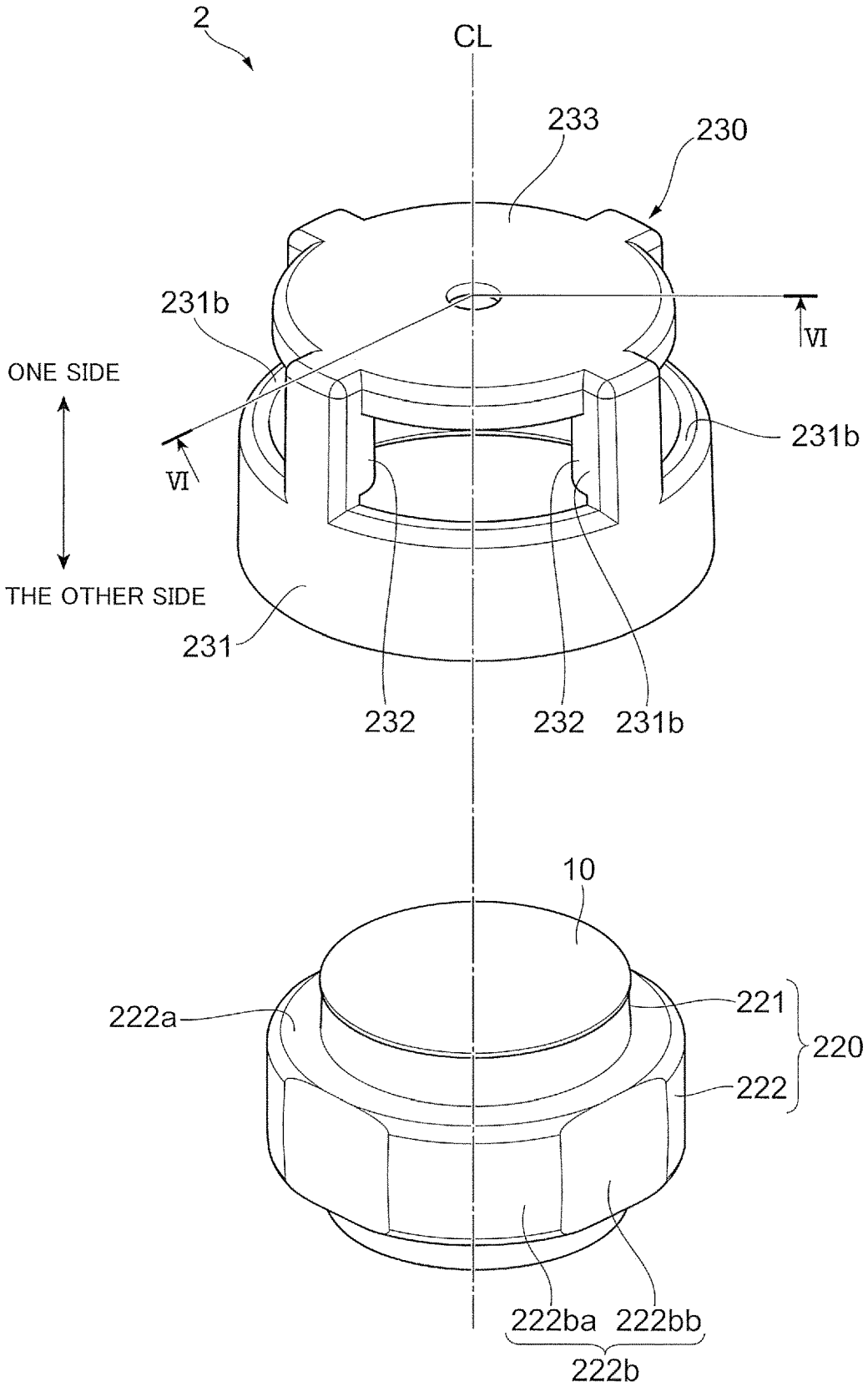
FIG. 5 is a diagram illustrating a schematic configuration of a ventilation member according to the second exemplary embodiment.

FIG. 5 is a diagram illustrating a schematic configuration of a ventilation member 2 according to the second exemplary embodiment.

Figure 6:
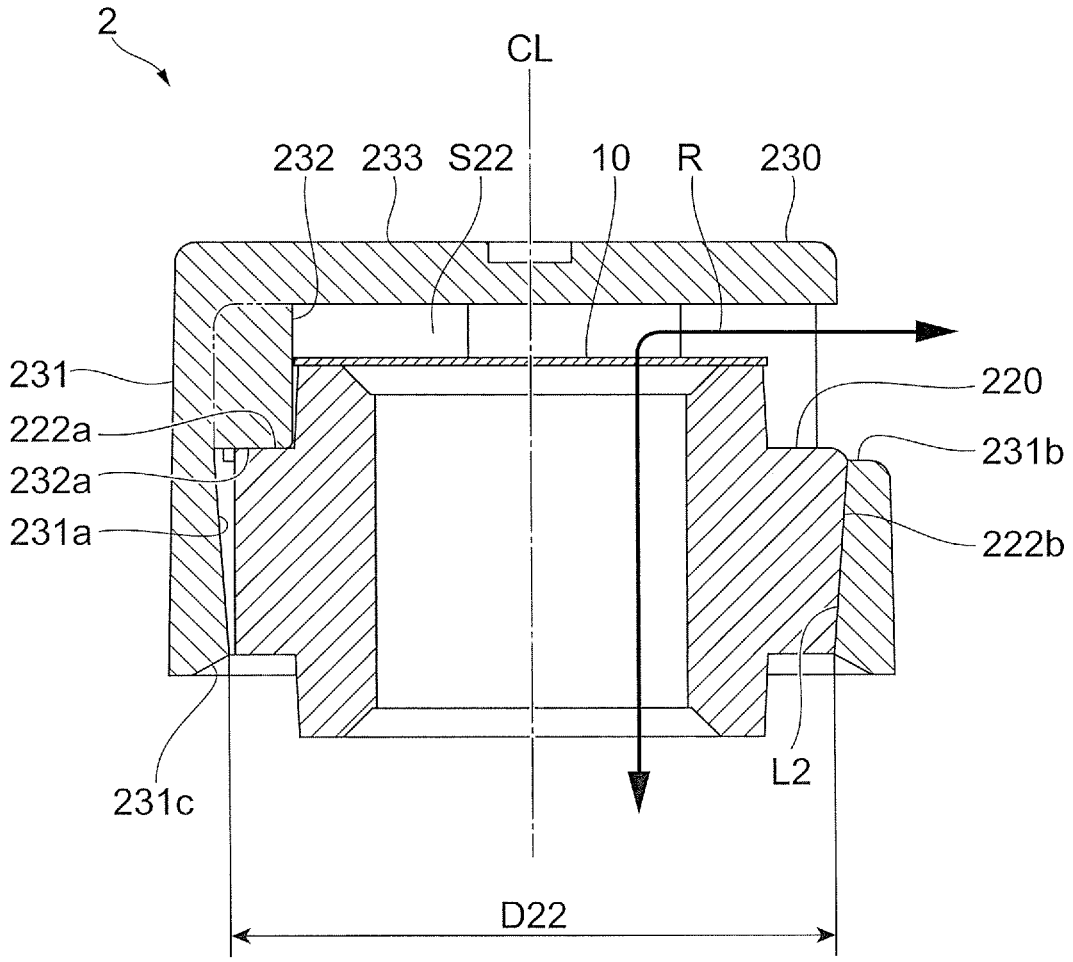
FIG. 6 is a cross-sectional view of the ventilation member according to the second exemplary embodiment taken along the line VI-VI in FIG. 5.

FIG. 6 is a cross-sectional view of the ventilation member 2 according to the second exemplary embodiment taken along the line VI-VI in FIG. 5.

The ventilation member 2 of the second exemplary embodiment is different from the ventilation member 1 of the first exemplary embodiment in the holding member 20 and the cover member 30. That is, the ventilation member 2 of the second exemplary embodiment includes the above-described ventilation film 10, a holding member 220 described later, and a cover member 230 described later. Hereinafter, explanation will be given of the difference of the holding member 220 of the second exemplary embodiment from the holding member 20 of the first exemplary embodiment and the difference of the cover member 230 of the second exemplary embodiment from the cover member 30 of the first exemplary embodiment. Note that a major difference lies in their shapes, and explanation of the material, method, liquid-repellent treatment, etc. will be omitted because they are the same between the embodiments.

[Holding Member 220]

The holding member 220 includes a cylindrical portion 221 of a cylindrical shape, and an outer projection portion 222 projecting outward from the cylindrical portion 221.

The holding member 220 holds the ventilation film 10 at one end of the cylindrical portion 221 in the centerline direction. The ventilation film 10 covers an opening at one end of the cylindrical portion 221 in the centerline direction. Further, the holding member 220 is mounted on the apparatus housing 100 (see FIG. 2) with the other end of the cylindrical portion 221 in the centerline direction being press-fitted to the mounted portion 110 of the apparatus housing 100 (see FIG. 2).

The outer projection portion 222 is a basically cylindrical portion projecting outward from an outer circumferential surface of the cylindrical portion 221. However, an outer circumferential surface 222*b* of the outer projection portion 222 includes plural (four in the second exemplary embodiment) rectangular flat surfaces in a circumferential direction at equal intervals, and arc-shaped surfaces 222*ba* and the rectangular surfaces 222*bb* of a rectangular shape are alternately arranged.

One end face 222*a*, which is an end face on one side of the outer projection portion 222 in the centerline direction, is a surface substantially perpendicular to the centerline direction. The outer circumferential surface 222*b* (the arc-shaped surfaces 222*ba* and the rectangular surfaces 222*bb*) of the outer projection portion 222 is a surface substantially parallel to the centerline direction.

<Cover Member 230>

The cover member 230 includes: a side wall portion 231 having a basically cylindrical shape; an inner projection portion 232 projecting inward from an inner circumferential surface 231*a* of the side wall portion 231; and a disk-shaped top portion 233 provided at one end of the side wall portion 231 and the inner projection portion 232 in the centerline direction. In FIG. 6, a cross-sectional shape of the side wall portion 231 and the top portion 233 is shown on the right side of the centerline CL, and a cross-sectional shape of the side wall portion 231, the inner projection portion 232 and the top portion 233 is shown on the left side of the centerline CL.

Plural (four in the second exemplary embodiment) inner projection portions 232 are formed in a circumferential direction at equal intervals and formed in the circumferential direction over a predetermined angle. The other end face 232*a*, which is an end face on the other side of the inner projection portion 232 in the centerline direction, is a surface substantially perpendicular to the centerline direction. Each of the other end faces 232*a* of the plural inner projection portions 232 is formed on the substantially same plane.

When the inner projection portions 232 are cut in a plane perpendicular to the centerline CL, inner surfaces of the plural inner projection portions 232 are formed substantially on the same circle, and the diameter of the circle is formed such that the diameter is larger than the outer diameter of the outer circumferential surface of the cylindrical portion 221 of the holding member 220.

A communication hole 231*b* communicating the inside and the outside is formed at a portion between two adjacent inner projection portions 232 of the side wall portion 231. That is, plural (four in the second exemplary embodiment) communication holes 231*b* are formed in the circumferential direction at predetermined intervals.

A portion of the side wall portion 231 on the other side in the centerline direction relative to the portion where the inner projection portions 232 are formed has a substantially cylindrical shape, but the inner circumferential surface 231*a* gradually goes inward (to the centerline CL side) as it goes from the one side toward the other side in the centerline direction. More specifically, as shown in FIG. 6, when the side wall portion 231 is cut in a plane including the centerline CL, a straight line L2 depicting the inner circumferential surface 231*a* is inclined with respect to the centerline CL, and the distance between the straight line L2 and the centerline CL is gradually smaller from the one side toward the other side in the centerline direction. In other words, the diameter D22 of the circle formed by cutting the inner circumferential surface 231*a* in a plane substantially perpendicular to the centerline direction is gradually smaller from the one side toward the other side in the centerline direction.

The diameter D22 of the inner circumferential surface 231*a* at its portion somewhat closer to the other side than the communication hole 231*b* in the centerline direction is substantially the same as the outer diameter of the outer circumferential surface 222*b* of the outer projection portion 222 of the holding member 220. The diameter D22 of the inner circumferential surface 231*a* is gradually smaller than the diameter of the outer circumferential surface 222*b* of the outer projection portion 222 of the holding member 220 from the one side toward the other side in the centerline direction.

Further, a chamfer 231*c* is formed at an inner portion of the other end side of the side wall portion 231 in the centerline direction.

As shown in FIG. 6, the top portion 233 is provided such that a gap S22 is formed between the top portion 233 and the ventilation film 10 in a state where the other end face 232*a* of the cover member 230 and the one end face 222*a* of the holding member 220 contact each other.

In the ventilation member 2 with the above described configuration, the cover member 230 is assembled such that the other end face 232*a* of the cover member 230 contacts the one end face 222*a* of the outer projection portion 222 of the holding member 220, as shown in FIG. 6. In other words, the cover member 230 is pushed against the holding member 220 until the other end face 232*a* of the cover member 230 abuts on the one end face 222*a* of the holding member 220.

As shown in FIG. 6, in a state where the other end face 232*a* of the cover member 230 is in contact with the one end face 222*a* of the holding member 220, the communication hole 231*b* formed in the side wall portion 231 of the cover member 230 and the gap S22 formed between the top portion 233 of the cover member 230 and the ventilation film 10 function as a ventilation passage R through which gas flows inside and outside the apparatus housing 100.

In the ventilation member 2 of the second exemplary embodiment configured as above, the ventilation film 10 held by the holding member 220 is not sandwiched by the cover member 230 and the holding member 220 in a state where the other end face 232*a* of the cover member 230 and the one end face 222*a* of the holding member 220 contact each other (in a state where the cover member 230 is assembled to the holding member 220). Thus the ventilation film 10 is free from buckling because the ventilation film 10 does not receive force from the cover member 230 when fixed to the holding member 220.

Further, since the cover member 230 is not present on the ventilation film 10 in a contacting manner, a liquid adhered to the cover member 230 by surface tension does not accumulate on the ventilation film 10.

Therefore, with the ventilation member 2 of the second exemplary embodiment, functions such as ventilation property, dust-proofness, water-proofness, oil-repellency and CCT-proofness are prevented from being impaired by buckling of the ventilation film 10 and accumulation of a liquid on the ventilation film 10.

Further, the inner circumferential surface 231*a* of the side wall portion 231 at a portion on the other side in the centerline direction relative to the portion where the inner projection portion 232 is provided gradually goes inward (to the centerline CL side) as it goes from the one side toward the other side in the centerline direction. In other words, the diameter D22 of the circle formed by cutting the inner circumferential surface 231*a* in a plane substantially perpendicular to the centerline direction is gradually smaller from the one side toward the other side in the centerline direction. On the other hand, the outer circumferential surface 222*b* of the outer projection portion 222 of the holding member 220 is a surface substantially parallel to the centerline direction. For this reason, when the cover member 230 is pushed against the holding member 220 until the other end face 232*a* of the cover member 230 abuts on the one end face 222*a* of the holding member 220, the side wall portion 231 of the cover member 230 is press-fitted to the outer projection portion 222 of the holding member 220. Further, an interference between the side wall portion 231 of the cover member 230 and the outer projection portion 222 of the holding member 220 is gradually larger from the one side toward the other side in the centerline direction. As a result, even if a compression set occurs in the fitting portion (press-fitting portion) between the cover member 230 and the holding member 220, the cover member 230 hardly moves toward the one side with respect to the holding member 220 in the centerline direction, as compared with a case where the interference of the fitting portion (press-fitting portion) is constant. Thus the cover member 230 hardly falls off the holding member 220.

The outer circumferential surface 222*b* of the outer projection portion 222 of the holding member 220 may gradually go inward (to the centerline CL side) as it goes from the one side toward the other side in the centerline direction, similarly to the inner circumferential surface 231*a* of the cover member 230. With the outer circumferential surface 222*b* of the outer projection portion 222 of the holding member 220 having this shape, the cover member 230 hardly falls off the holding member 220 too and the inner circumferential surface of the holding member 220 is prevented from deforming while the cover member 230 is mounted to the holding member 220.

Third Exemplary Embodiment

Figure 7:
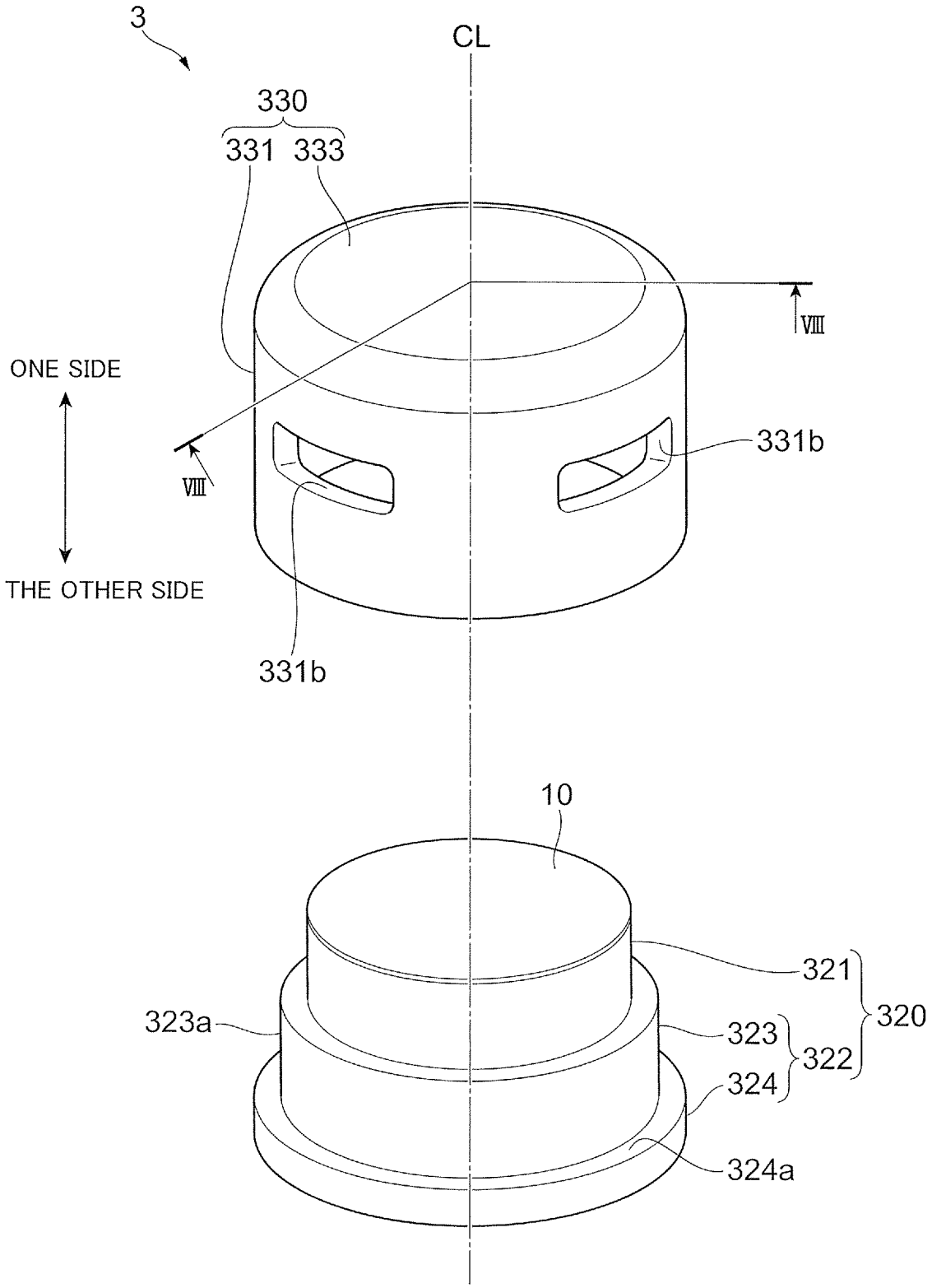
FIG. 7 is a diagram illustrating a schematic configuration of a ventilation member according to the third exemplary embodiment.

FIG. 7 is a diagram illustrating a schematic configuration of a ventilation member 3 according to the third exemplary embodiment.

Figure 8:
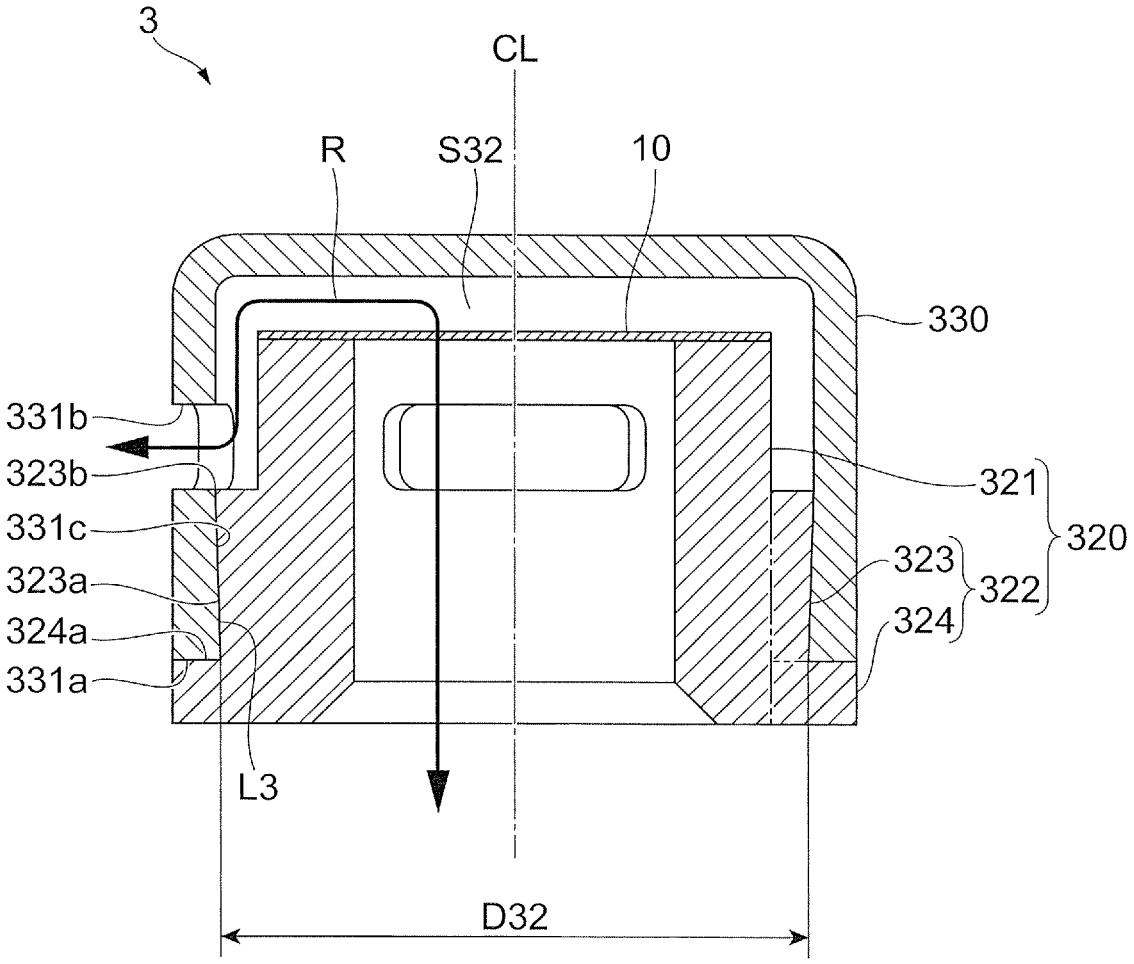
FIG. 8 is a cross-sectional view of the ventilation member according to the third exemplary embodiment taken along the line VIII-VIII in FIG. 7.

FIG. 8 is a cross-sectional view of the ventilation member 3 according to the third exemplary embodiment taken along the line VIII-VIII in FIG. 7.

The ventilation member 3 of the third exemplary embodiment is different from the ventilation member 1 of the first exemplary embodiment in the holding member 20 and the cover member 30. That is, the ventilation member 3 of the third exemplary embodiment includes the above-described ventilation film 10, a holding member 320 described later, and a cover member 330 described later. Hereinafter, explanation will be given of the difference of the holding member 320 of the third exemplary embodiment from the holding member 20 of the first exemplary embodiment and the difference of the cover member 330 of the third exemplary embodiment from the cover member 30 of the first exemplary embodiment. Note that a major difference lies in their shapes, and explanation of the material, method, liquid-repellent treatment, etc. will be omitted because they are the same between the embodiments.

[Holding Member 320]

The holding member 320 includes a cylindrical portion 321 of a cylindrical shape, and an outer projection portion 322 projecting outward from the cylindrical portion 321.

The holding member 320 holds the ventilation film 10 at one end of the cylindrical portion 321 in the centerline direction. The ventilation film 10 covers an opening at one end of the cylindrical portion 321 in the centerline direction. Further, the holding member 320 is mounted on the apparatus housing 100 (see FIG. 2) with the other end of the cylindrical portion 321 in the centerline direction being press-fitted to the mounted portion 110 of the apparatus housing 100 (see FIG. 2).

As shown in FIGS. 7 and 8, the outer projection portion 322 includes portions projecting outward in two stages from the outer circumferential surface of the cylindrical portion 321, namely a first outer projection portion 323 on one side in the centerline direction, and a second outer projection portion 324 on the other side in the centerline direction. The first outer projection portion 323 projects in a cylindrical shape from the outer circumferential surface of the cylindrical portion 321. The second outer projection portion 324 projects in a doughnut-shape from the outer circumferential surface of the cylindrical portion 321. In other words, the size of the first outer projection portion 323 in the centerline direction is larger than the size of the second outer projection portion 324 in the centerline direction. The projection amount of the second outer projection portion 324 from the outer circumferential surface of the cylindrical portion 321 is larger than the projection amount of the first outer projection portion 323 from the outer circumferential surface of the cylindrical portion 321.

An outer circumferential surface 323*a* of the first outer projection portion 323 is a surface substantially parallel to the centerline direction.

One end face 324*a*, which is an end face on one side of the second outer projection portion 324 in the centerline direction, is a surface substantially perpendicular to the centerline direction.

[Cover Member 330]

The cover member 330 includes: a side wall portion 331 having a cylindrical shape and as an example of the cylindrical portion; and a disk-shaped top portion 333 provided at one end of the side wall portion 331 in the centerline direction and as an example of the lid portion.

The cover member 330 is assembled such that the other end face 331*a* (described later) of the side wall portion 331 contacts one end face 324*a* of the second outer projection portion 324 of the holding member 320. In other words, the cover member 330 is pushed against the holding member 320 until the other end face 331*a* of the cover member 330 abuts on the one end face 324*a* of the holding member 320.

In the side wall portion 331, plural (four in the third exemplary embodiment) communication holes 331*b* communicating the inside and the outside are formed in the circumferential direction at predetermined intervals.

The plural communication holes 331*b* are formed to be positioned on one side in the centerline direction relative to the first outer projection portion 323 of the holding member 320 in a state where the other end face 331*a*, which is the other end face of the side wall portion 331 in the centerline direction, contacts the one end face 324*a* of the second outer projection portion 324 of the holding member 320 (the state shown in FIG. 8).

In the state where the other end face 331*a* of the side wall portion 331 contacts the one end face 324*a* of the second outer projection portion 324 of the holding member 320 (the state shown in FIG. 8), an inner circumferential surface 331*c* of the side wall portion 331 gradually goes inward (to the centerline CL side) as it goes from a position facing one end 323*b* in the centerline direction of the first outer projection portion 323 of the holding member 320 toward the other side in the centerline direction. More specifically, as shown in FIG. 8, when the side wall portion 331 is cut in a plane including the centerline CL, a straight line L3 depicting the inner circumferential surface 331*c* is inclined with respect to the centerline CL, and the distance between the straight line L3 and the centerline CL is gradually smaller from the one side toward the other side in the centerline direction. In other words, the diameter D32 of the circle formed by cutting the inner circumferential surface 331*c* in a plane substantially perpendicular to the centerline direction is gradually smaller from the one side toward the other side in the centerline direction.

In the ventilation member 3 with the above described configuration, the cover member 330 (see FIG. 7) is assembled such that the other end face 331*a* of the side wall portion 331 of the cover member 330 contacts the one end face 324*a* of the second outer projection portion 324 of the holding member 320, as shown in FIG. 8. Further, as shown in FIG. 8, in a state where the other end face 331*a* of the cover member 330 is in contact with the one end face 324*a* of the holding member 320, the communication hole 331*b* formed in the side wall portion 331 of the cover member 330 and a gap S32 formed between the top portion 333 of the cover member 330 and the ventilation film 10 function as a ventilation passage R through which gas flows inside and outside the apparatus housing 100.

In the ventilation member 3 of the third exemplary embodiment configured as above, the ventilation film 10 held by the holding member 320 is not sandwiched by the cover member 330 and the holding member 320 in a state where the other end face 331*a* of the cover member 330 and the one end face 324*a* of the holding member 320 contact each other (in a state where the cover member 330 is assembled to the holding member 320). Thus the ventilation film 10 is free from buckling because the ventilation film 10 does not receive force from the cover member 330 when fixed to the holding member 320.

Further, since the cover member 330 is not present on the ventilation film 10 in a contacting manner, a liquid adhered to the cover member 330 by surface tension does not accumulate on the ventilation film 10.

Therefore, with the ventilation member 3 of the third exemplary embodiment, functions such as ventilation property, dust-proofness, water-proofness, oil-repellency and CCT-proofness are prevented from being impaired by buckling of the ventilation film 10 and accumulation of a liquid on the ventilation film 10.

In the state where the other end face 331*a* of the side wall portion 331 is in contact with the one end face 324*a* of the second outer projection portion 324 of the holding member 320 (the state shown in FIG. 8), the inner circumferential surface 331*c* of the side wall portion 331 gradually goes inward as it goes from a position facing the one end 323*b* in the centerline direction of the first outer projection portion 323 of the holding member 320 toward the other side in the centerline direction. In other words, the diameter D32 of the circle formed by cutting the inner circumferential surface 331*c* in a plane substantially perpendicular to the centerline direction is gradually smaller from the one side toward the other side in the centerline direction. On the other hand, the outer circumferential surface 323*a* of the first outer projection portion 323 of the holding member 320 is a surface substantially parallel to the centerline direction. For this reason, when the cover member 330 is pushed against the holding member 320 until the other end face 331*a* of the cover member 330 abuts on the one end face 324*a* of the holding member 320, the side wall portion 331 of the cover member 330 is press-fitted to the first outer projection portion 323 of the holding member 320. Further, an interference between the side wall portion 331 of the cover member 330 and the first outer projection portion 323 of the holding member 320 is gradually larger from the one side toward the other side in the centerline direction. As a result, even if a compression set occurs in the fitting portion (press-fitting portion) between the cover member 330 and the holding member 320, the cover member 330 hardly moves toward the one side with respect to the holding member 320 in the centerline direction, as compared with a case where the interference of the fitting portion (press-fitting portion) is constant. Thus the cover member 330 hardly falls off the holding member 320.

The outer circumferential surface 323*a* of the first outer projection portion 323 of the holding member 320 may gradually go inward (to the centerline CL side) as it goes from the one side toward the other side in the centerline direction, similarly to the inner circumferential surface 331*c* of the cover member 330. With the outer circumferential surface 323*a* of the first outer projection portion 323 of the holding member 320 having this shape, the cover member 330 hardly falls off the holding member 320 too and the inner circumferential surface of the holding member 320 is prevented from deforming while the cover member 330 is mounted to the holding member 320.

A chamfer may be formed at one end, in the centerline direction, of the first outer projection portion 323 of the outer projection portion 322 of the holding member 320 such that the diameter of the outer circumferential surface 323*a* is gradually larger from the one side toward the other side in the centerline direction.

Figure 9:
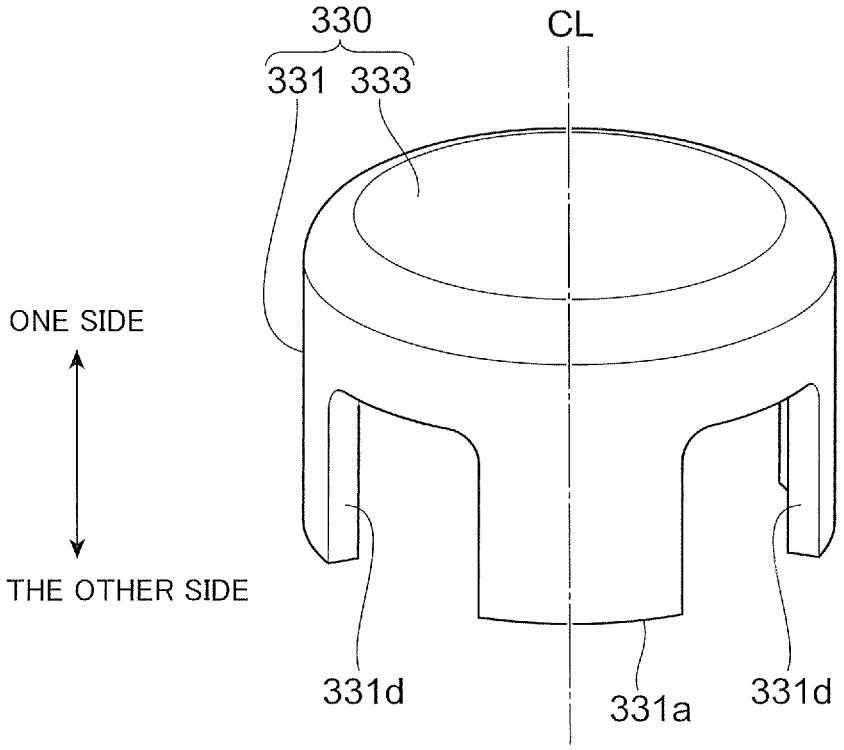
FIG. 9 is a diagram illustrating a modified example of the cover member according to the third exemplary embodiment.

Modified Example of the Cover Member 330 According to the Third Exemplary Embodiment FIG. 9 is a diagram illustrating a modified example of the cover member 330 according to the third exemplary embodiment.

In the cover member 330 of the third exemplary embodiment as described above, a cutout 331*d* may be formed instead of the communication hole 331*b*, as shown in FIG. 9. The cutout 331*d* extends the other end of the communication hole 331*b* in the centerline direction to the other end face 331*a* of the side wall portion 331. In the cover member 330 of the third exemplary embodiment, forming the cutout 331*d* instead of the communication hole 331*b* can provide the same effects as those described above.

Fourth Exemplary Embodiment

Figure 10:
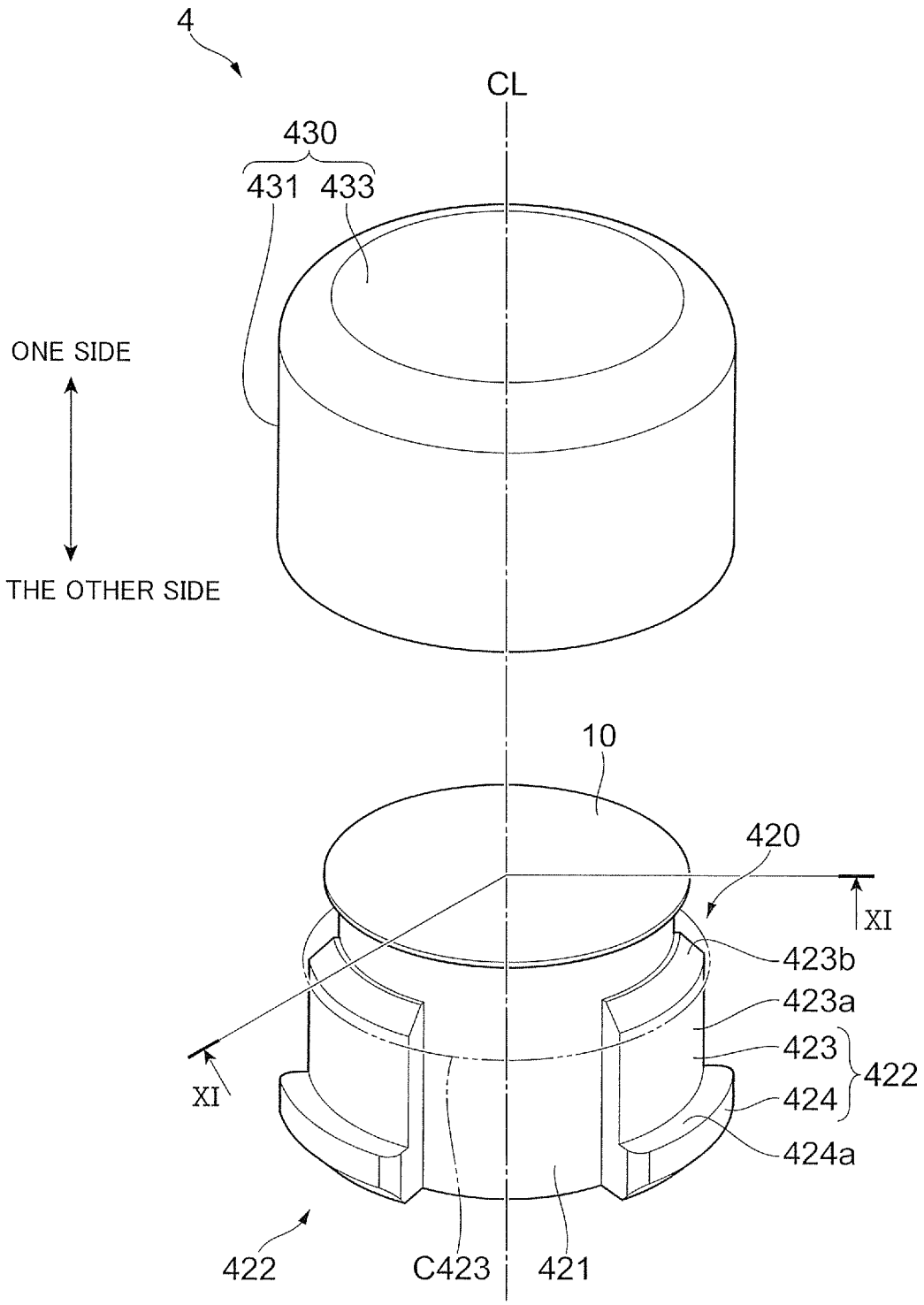
FIG. 10 is a diagram illustrating a schematic configuration of a ventilation member according to the fourth exemplary embodiment.

FIG. 10 is a diagram illustrating a schematic configuration of a ventilation member 4 according to the fourth exemplary embodiment.

Figure 11:
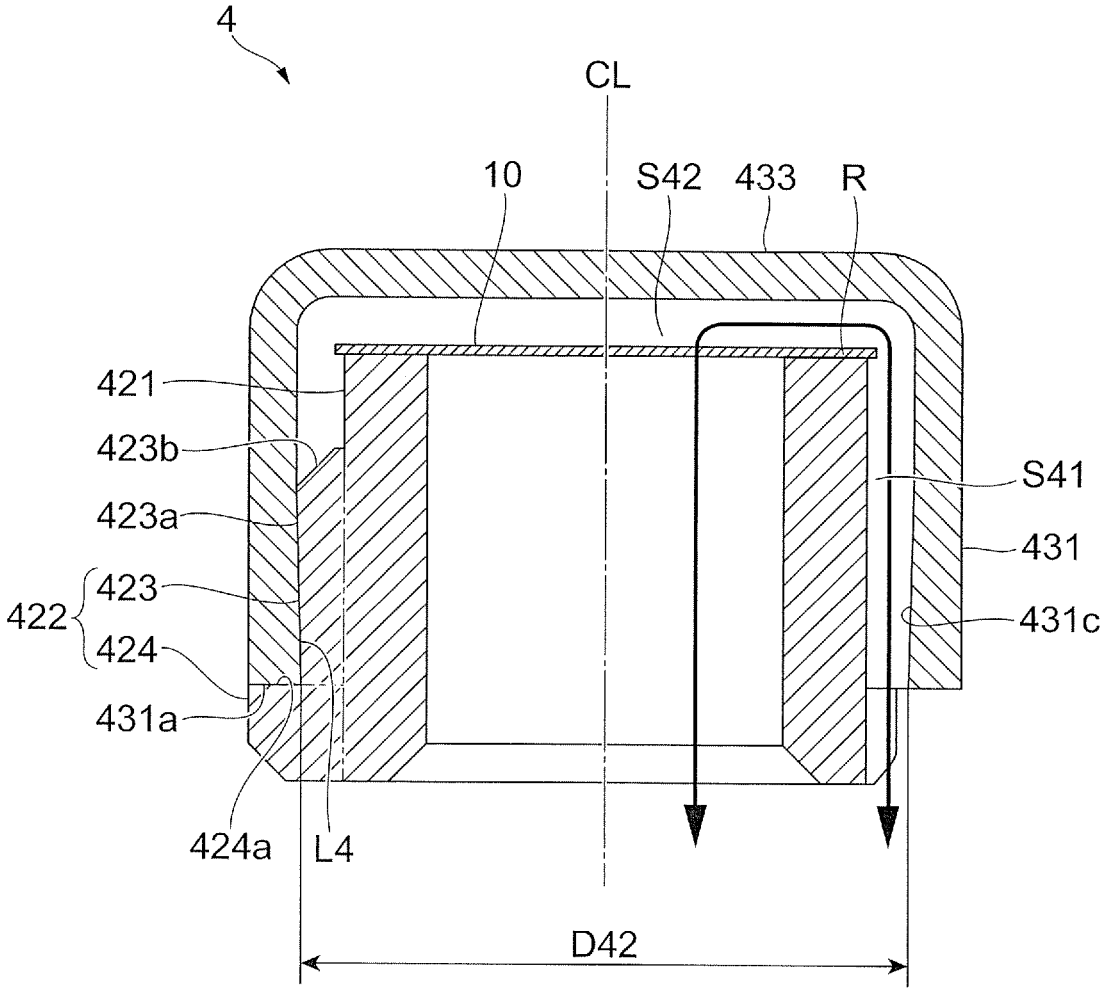
FIG. 11 is a cross-sectional view of the ventilation member according to the fourth exemplary embodiment taken along the line XI-XI in FIG. 10.

FIG. 11 is a cross-sectional view of the ventilation member 4 according to the fourth exemplary embodiment taken along the line XI-XI in FIG. 10.

The ventilation member 4 of the fourth exemplary embodiment is different from the ventilation member 1 of the first exemplary embodiment in the holding member 20 and the cover member 30. That is, the ventilation member 4 of the fourth exemplary embodiment includes the above-described ventilation film 10, a holding member 420 described later, and a cover member 430 described later. Hereinafter, explanation will be given of the difference of the holding member 420 of the fourth exemplary embodiment from the holding member 20 of the first exemplary embodiment and the difference of the cover member 430 of the fourth exemplary embodiment from the cover member 30 of the first exemplary embodiment. Note that a major difference lies in their shapes, and explanation of the material, method, liquid-repellent treatment, etc. will be omitted because they are the same between the embodiments.

[Holding Member 420]

The holding member 420 includes a cylindrical portion 421 of a cylindrical shape, and an outer projection portion 422 projecting outward from the cylindrical portion 421.

The holding member 420 holds the ventilation film 10 at one end of the cylindrical portion 421 in the centerline direction. The ventilation film 10 covers an opening at one end of the cylindrical portion 421 in the centerline direction. Further, the holding member 420 is mounted on the apparatus housing 100 (see FIG. 2) with the other end of the cylindrical portion 421 in the centerline direction being press-fitted to the mounted portion 110 of the apparatus housing 100 (see FIG. 2).

Plural (four in the fourth exemplary embodiment) outer projection portions 422 are formed in a circumferential direction at equal intervals. As shown in FIGS. 10 and 11, each outer projection portion 422 includes portions projecting outward in two stages from an outer circumferential surface of the cylindrical portion 421, namely a first outer projection portion 423 on one side in the centerline direction, and a second outer projection portion 424 on the other side in the centerline direction. The size of the first outer projection portion 423 in the centerline direction is larger than the size of the second outer projection portion 424 in the centerline direction. The projection amount of the second outer projection portion 424 from the outer circumferential surface of the cylindrical portion 421 is larger than the projection amount of the first outer projection portion 423 from the outer circumferential surface of the cylindrical portion 421.

When plural (four in the fourth exemplary embodiment) first outer projection portions 423 are cut in a plane perpendicular to the centerline CL, outer circumferential surfaces 423*a* of the plural first outer projection portions 423 are formed substantially on the same circle C423. The outer circumferential surface 423*a* of the first outer projection portion 423 is a surface substantially parallel to the centerline direction, and the size of the circle C423 is constant from the one side toward the other side in the centerline direction. However, as shown in FIGS. 10 and 11, a chamfer 423*b* may be formed on one end of the first outer projection portion 423 in the centerline direction, such that the diameter of the circle C423 gradually increases from the one side toward the other side in the centerline direction.

One end face 424*a*, which is an end face on one side of the second outer projection portion 424 in the centerline direction, is a surface substantially perpendicular to the centerline direction.

[Cover Member 430]

The cover member 430 includes: a side wall portion 431 having a cylindrical shape; and a disk-shaped top portion 433 provided at one end of the side wall portion 431 in the centerline direction.

The radial size of the other end face 431*a*, which is the other end face of the side wall portion 431 in the centerline direction, is substantially same as the radial size of the one end face 424*a* of the second outer projection portion 424 of the outer projection portion 422 of the holding member 420.

The cover member 430 is assembled such that the other end face 431*a* of the side wall portion 431 contacts the one end face 424*a* of the outer projection portion 422 of the holding member 420. In other words, the cover member 430 is pushed against the holding member 420 until the other end face 431*a* of the cover member 430 abuts on the one end face 424*a* of the holding member 420.

In the state where the other end face 431*a* of the side wall portion 431 contacts the one end face 424*a* of the second outer projection portion 424 of the holding member 420 (the state shown in FIG. 11), an inner circumferential surface 431*c* of the side wall portion 431 gradually goes inward (to the centerline CL side) as it goes from a position facing one end in the centerline direction of the first outer projection portion 423 of the holding member 420 toward the other side in the centerline direction. More specifically, as shown in FIG. 11, when the side wall portion 431 is cut in a plane including the centerline CL, a straight line L4 depicting the inner circumferential surface 431*c* is inclined with respect to the centerline CL, and the distance between the straight line L4 and the centerline CL is gradually smaller from the one side toward the other side in the centerline direction. In other words, the diameter D42 of the circle formed by cutting the inner circumferential surface 431*c* in a plane substantially perpendicular to the centerline direction is gradually smaller from the one side toward the other side in the centerline direction.

In the ventilation member 4 with the above described configuration, as shown in FIG. 11, in a state where the other end face 431*a* of the side wall portion 431 of the cover member 430 is in contact with the one end face 424*a* of the outer projection portion 422 of the holding member 420, a gap S41 formed between the side wall portion 431 of the cover member 430 and the outer circumferential surface of the cylindrical portion 421 of the holding member 420, and a gap S42 formed between the top portion 433 of the cover member 430 and the ventilation film 10 function as a ventilation passage R through which gas flows inside and outside of the apparatus housing 100 (see FIG. 2).

In the ventilation member 4 of the fourth exemplary embodiment configured as above, the ventilation film 10 held by the holding member 420 is not sandwiched by the cover member 430 and the holding member 420 in a state where the other end face 431*a* of the cover member 430 and the one end face 424*a* of the holding member 420 contact each other (in a state where the cover member 430 is assembled to the holding member 420). Thus the ventilation film 10 is free from buckling because the ventilation film 10 does not receive force from the cover member 430 when fixed to the holding member 420.

Further, since the cover member 430 is not present on the ventilation film 10 in a contacting manner, a liquid adhered to the cover member 430 by surface tension does not accumulate on the ventilation film 10.

Therefore, with the ventilation member 4 of the fourth exemplary embodiment, functions such as ventilation property, dust-proofness, water-proofness, oil-repellency and CCT-proofness are prevented from being impaired by buckling of the ventilation film 10 and accumulation of a liquid on the ventilation film 10.

In the state where the other end face 431*a* of the side wall portion 431 is in contact with the one end face 424*a* of the second outer projection portion 424 of the holding member 420 (the state shown in FIG. 11), the inner circumferential surface 431*c* of the side wall portion 431 gradually goes inward as it goes from a position facing the one end in the centerline direction of the first outer projection portion 423 of the holding member 420 toward the other side in the centerline direction. In other words, the diameter D42 of the circle formed by cutting the inner circumferential surface 431*c* in a plane substantially perpendicular to the centerline direction is gradually smaller from the one side toward the other side in the centerline direction. On the other hand, the outer circumferential surface 423*a* of the first outer projection portion 423 of the holding member 420 is a surface substantially parallel to the centerline direction. For this reason, when the cover member 430 is pushed against the holding member 420 until the other end face 431*a* of the cover member 430 abuts on the one end face 424*a* of the holding member 420, the side wall portion 431 of the cover member 430 is press-fitted to the first outer projection portion 423 of the holding member 420. Further, an interference between the side wall portion 431 of the cover member 430 and the first outer projection portion 423 of the holding member 420 is gradually larger from the one side toward the other side in the centerline direction. As a result, even if a compression set occurs in the fitting portion (press-fitting portion) between the cover member 430 and the holding member 420, the cover member 430 hardly moves toward the one side with respect to the holding member 420 in the centerline direction, as compared with a case where the interference of the fitting portion (press-fitting portion) is constant. Thus the cover member 430 hardly falls off the holding member 420.

The outer circumferential surface 423*a* of the first outer projection portion 423 of the holding member 420 may gradually go inward (to the centerline CL side) as it goes from the one side toward the other side in the centerline direction, similarly to the inner circumferential surface 431*c* of the cover member 430. With the outer circumferential surface 423*a* of the first outer projection portion 423 of the holding member 420 having this shape, the cover member 430 hardly falls off the holding member 420 too and the inner circumferential surface of the holding member 420 is prevented from deforming while the cover member 430 is mounted to the holding member 420.

REFERENCE SIGNS LIST

1 Ventilation member
10 Ventilation film
20 Holding member
21 Cylindrical portion
22 Outer projection portion
30 Cover member
31 Side wall portion
32 Inner projection portion
33 Top portion
100 Apparatus housing
110 Mounted portion

The invention claimed is:

1. A ventilation member comprising:

a cylindrical member of a cylindrical shape, the cylindrical member including an outer projection portion projecting outward from an outer circumferential surface of the cylindrical member;

a ventilation body mounted so as to cover one end of the cylindrical member in a centerline direction, the ventilation body preventing a liquid and a solid from entering an inside of the cylindrical member from an outside of the cylindrical member, the ventilation body permitting a flow of gas between the inside and the outside; and a cover member provided around the ventilation body, the cover member including a cylindrical portion, a lid portion, and an inner projection portion, the lid portion closing one end of the cylindrical portion in the centerline direction, the inner projection portion projecting inward from an inner circumferential surface of the cylindrical portion, abutting the outer projection portion in the centerline direction on a surface provided around the ventilation body so as to prevent the cover member from contacting the ventilation body in the centerline direction and thus maintain a ventilation passage between the ventilation body and the lid portion, and not pressing the ventilation body, and the ventilation passage allowing gas to flow therethrough.

2. The ventilation member according to claim 1, wherein the ventilation passage is formed by contact between one end face of the outer projection portion of the cylindrical member in the centerline direction and the other end face of the inner projection portion of the cover member in the centerline direction.

3. The ventilation member according to claim 1, wherein the cover member is prevented from moving to one side in the centerline direction by contact between an outer circumferential surface of the outer projection portion of the cylindrical member and an inner surface of the inner projection portion of the cover member.

4. The ventilation member according to claim 2, wherein the cover member is prevented from moving to one side in the centerline direction by contact between an outer circumferential surface of the outer projection portion of the cylindrical member and an inner surface of the inner projection portion of the cover member.

5. The ventilation member according to claim 3, wherein the outer circumferential surface of the outer projection portion of the cylindrical member is parallel to the centerline direction, and the inner surface of the inner projection portion of the cover member gradually goes inward as the inner surface goes from one side toward the other side in the centerline direction.

6. A ventilation member comprising:

a cylindrical member of a cylindrical shape, the cylindrical member including an outer projection portion projecting outward from an outer circumferential surface of the cylindrical member;

a ventilation body mounted so as to cover one end of the cylindrical member in a centerline direction, the ventilation body preventing a liquid and a solid from entering an inside of the cylindrical member from an outside of the cylindrical member, the ventilation body permitting a flow of gas between the inside and the outside; and a cover member provided around the ventilation body, the cover member including a cylindrical portion and a lid portion, the lid portion closing one end of the cylindrical portion in the centerline direction, the cylindrical portion abutting the outer projection portion the centerline direction on a surface provided around the ventilation body so as to prevent the cover member from contacting the ventilation body in the centerline direction and thus maintain a ventilation passage between the ventilation body and the lid portion, and not pressing the ventilation body, and the ventilation passage allowing gas to flow therethrough.

7. The ventilation member according to claim 6, wherein the cylindrical portion of the cover member is press-fitted to the outer projection portion of the cylindrical member, and an interference of a press-fitting portion is larger on the other side than on one side in the centerline direction.

8. A ventilation member comprising:

a ventilation body mounted so as to cover one end of a cylindrical portion in a centerline direction, the ventilation body preventing a liquid and a solid from entering an inside of the cylindrical portion from an outside of the cylindrical portion, the ventilation body permitting a flow of gas between the inside and the outside;

a surrounding portion provided around the ventilation body; and a preventing portion at a position where the ventilation body is not mounted, the preventing portion preventing the ventilation body and the surrounding portion from coming close to each other in the centerline direction, wherein the preventing portion includes an outer projection portion projecting outward from the cylindrical portion, and an inner projection portion projecting inward from a portion of the surrounding portion provided around the cylindrical portion, the inner projection portion abutting the outer projection portion in the centerline direction on a surface provided around the ventilation body so as to prevent the surrounding portion from pressing the ventilation body in the centerline direction.

9. A lamp comprising:

a housing storing a light source; and a ventilation member mounted on the housing, the ventilation member preventing a liquid and a solid from entering an inside of the housing, the ventilation member permitting a flow of gas between the inside and an outside of the housing, wherein the ventilation member includes:

a cylindrical member of a cylindrical shape, the cylindrical member including an outer projection portion projecting outward from an outer circumferential surface of the cylindrical member;

a ventilation body mounted so as to cover one end of the cylindrical member in a centerline direction, the ventilation body preventing a liquid and a solid from entering an inside of the cylindrical member from an outside of the cylindrical member, the ventilation body permitting a flow of gas between the inside and the outside; and a cover member provided around the ventilation body, the cover member including a cylindrical portion, a lid portion, and an inner projection portion, the lid portion closing one end of the cylindrical portion in the centerline direction, the inner projection portion projecting inward from an inner circumferential surface of the cylindrical portion, abutting the outer projection portion the centerline direction on a surface provided around the ventilation body so as to prevent the cover member from contacting the ventilation body in the centerline direction and thus maintain a ventilation passage between the ventilation body and the lid portion, and not pressing the ventilation body, and the ventilation passage allowing gas to flow therethrough.

* * * * *